US005486003A

United States Patent [19]

Loew et al.

[11] Patent Number: 5,486,003

[45] Date of Patent: Jan. 23, 1996

[54] GOLF TRAINING SYSTEM

[76] Inventors: Ellen G. Loew, 139 E. Hampton Rd., Binghamton, N.Y. 13903; Joseph D. Gaetani, 22 Helen St., Johnson City, N.Y. 13790

[21] Appl. No.: 942,300

[22] Filed: Sep. 9, 1992

[51] Int. Cl.[6] ..... A63B 69/36

[52] U.S. Cl. ..... 273/187 R; 273/187.6; 273/35 A; 434/252

[58] Field of Search ..... 273/35 A, 187.2, 273/187.6, 187 R; 434/252

[56] References Cited

U.S. PATENT DOCUMENTS

| | | | |
|---|---|---|---|
| D. 198,459 | 6/1964 | Blythe, Jr. | D34/5 |
| 1,173,262 | 2/1916 | Gunzburg | 273/182 A |
| 1,410,811 | 3/1922 | Lewis | 273/35 A |
| 1,558,762 | 10/1925 | Richter | 273/35 A |
| 3,915,457 | 10/1975 | Casey | 273/183 E |
| 3,917,278 | 11/1975 | Steinman, Jr. | 273/183 E |
| 3,918,073 | 11/1975 | Henderson et al. | 273/187 A |
| 4,383,687 | 5/1983 | Wolff | 273/35 A |

*Primary Examiner*—George J. Marlo
*Attorney, Agent, or Firm*—Hugh D. Jaeger

[57] ABSTRACT

A golf training mirror for viewing a golfer's body to determine proper swing alignment comprising:

a. a convex mirror having a reflective surface generally free of lines for viewing reflection of a golfer's body;

b. at least one pair of horizontal lines on the reflective surface for alignment with a specific part of a golfer's body;

c. at least one rectangular box on the reflective surface for alignment with a second specific part of the golfer's body; and, d. a vertical line generally bisecting the reflective surface for aligning the golfer's body.

21 Claims, 5 Drawing Sheets

GOLF TRAINING SYSTEM

BACKGROUND OF THE INVENTION

1. Field of the Invention

The present invention relates to golf, and more particularly, relates to a golf training system in the form of a mirror having horizontal and vertical lines and boxes on a convex mirror surface for reference to the golfer's body members.

2. Description of the Prior Art

Prior art devices consisted of reflective devices often of a planar variety and having a minimum of non-specific and vague reference lines placed about the surface for visual reference to the golfer's stance. Often these devices had an adjustable support stand used to support the reflective device, thus leaving the specific angle of reflection to be haphazardly determined by the subject golfer. The use of planar mirror also requires a large reflective surface for reflection of a total and complete golfer image.

The present invention provides a golf training system convex mirror giving full image viewing, and having a predetermined angular relationship to the immediate terrain by fixation with a collapsible support stand.

SUMMARY OF THE INVENTION

The general purpose of the present invention is to provide a golf training system comprised of a convex mirror having line markings on its surface and a collapsible and attached support stand secured to its back. Besides a vertical line and bisecting horizontal line as has been seen in previous patents, this golf training system mirror has boxes on both the right and left side of the vertical line for head placement. The mirror includes two horizontal lines on the upper part of the mirror to align shoulders, and two horizontal lines at foot level to help the golfer align his/her shoulders with his/her feet. The two boxes at the lower part of the mirror allow the golfer to place the ball in either box corresponding to the length of the club used. The size of the mirror allows a golfer to stand close to the mirror and see his whole body in correct perspective. In addition, a stand on the back surface of the mirror is non-adjustable and has been made with specifications corresponding to the lines on the front of the mirror. This allows both short and tall persons to align themselves correctly in front of the mirror without having to tilt the mirror. The stand is collapsible and is held in position by VELCRO straps. There is a handle at the top of the mirror which makes the mirror very portable.

According to one embodiment of the present invention, there is provided a convex mirror for a golf training system having a collapsible stand secured to the rearward surface, a carrying handle, a pair of upper and horizontal shoulder alignment lines, a pair of lower and horizontal foot alignment lines, a vertical line through the center of the mirror bisecting the pairs of upper and lower horizontal lines, a pair of head alignment boxes aligned with respect to the vertical line and the horizontal shoulder alignment lines, and a pair of ball alignment boxes aligned with respect to the vertical line and the horizontal foot adjustment lines.

One significant aspect and feature of the present invention is a golf training system in the form of a convex mirror having sets of upper and lower parallel lines for reflective placement of shoulders and feet with respect to a vertical line.

Another significant aspect and feature of the present invention is the incorporation of head and ball alignment boxes on the mirror surface.

A further significant aspect and feature of the present invention is a golf training system suitable for golfers of different heights.

Yet a further significant aspect and feature of the present invention is the use of a fixed geometry mirror support stand which can be collapsed for transport or storage.

Still another significant aspect and feature of the present invention is a golf training system mirror which allows a golf pro to instruct a golfer having the student observe the points the pro is making and then watch himself, thus causing the student to form a mental image of the lesson and body position.

Yet another significant aspect and feature of the present invention is a golf training system mirror in which advanced golfers can observe their grip, swing and alignment and make minor adjustments as necessary.

Having thus described one embodiment of the present invention, it is one object of the present invention to provide a golf training system in the form of a mirror having multiple reference lines and boxes thereupon for visual correlation with a golfer's stance and swing.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
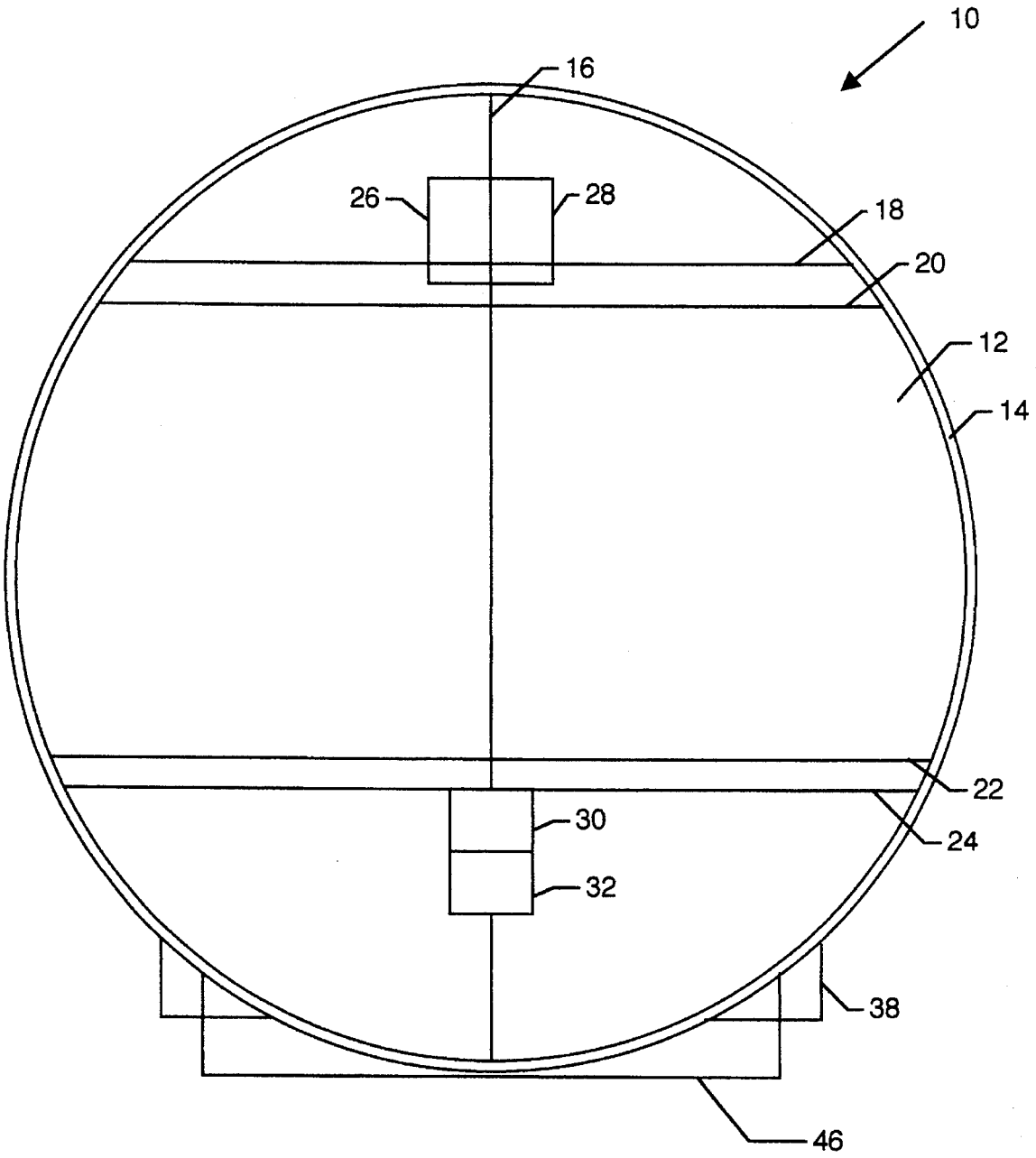
FIG. 1 illustrates a front view of the golf training system, the present invention.

FIG. 1 illustrates a front view of a golf training system 10 comprised of a convex PLEXIGLASS mirror 12; a framework 14 about the edge of the convex PLEXIGLASS mirror 12; a vertical line 16 aligned through the center of the convex PLEXIGLASS mirror 12, intersecting the edges of the convex PLEXIGLASS mirror 12; a pair of horizontally aligned parallel upper and lower lines 18 and 20, also known as the shoulder lines, intersecting the upper portion of the vertical line 16 and the edges of the convex PLEXIGLASS mirror 12; and a pair of horizontally aligned parallel upper and lower lines 22 and 24, also known as the foot lines, intersecting the lower portion of the vertical line 16 and the edges of the convex PLEXIGLASS mirror 12. Adjacent lined boxes 26 and 28, known as head boxes, align horizontally to each other and intersect the vertical line 16 and the upper shoulder line 18. Adjacent lined boxes 30 and 32, also known as ball boxes, align vertically to each other and are placed on the vertical line 16 with the upper portion of the upper lined box being common to the lower foot line 24.

Figure 2:
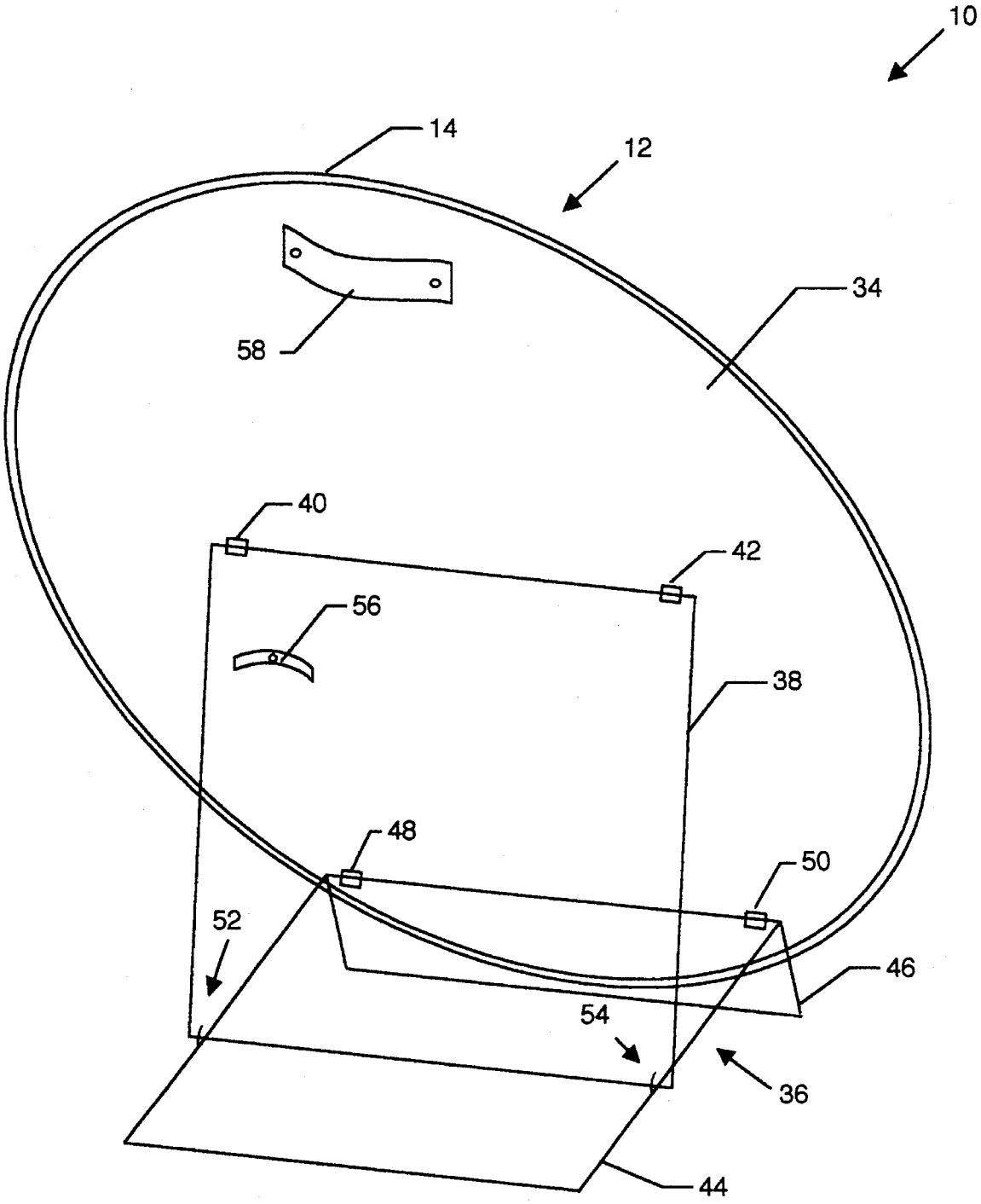
FIG. 2 illustrates a rear view in perspective of the present invention.
Figure 3:
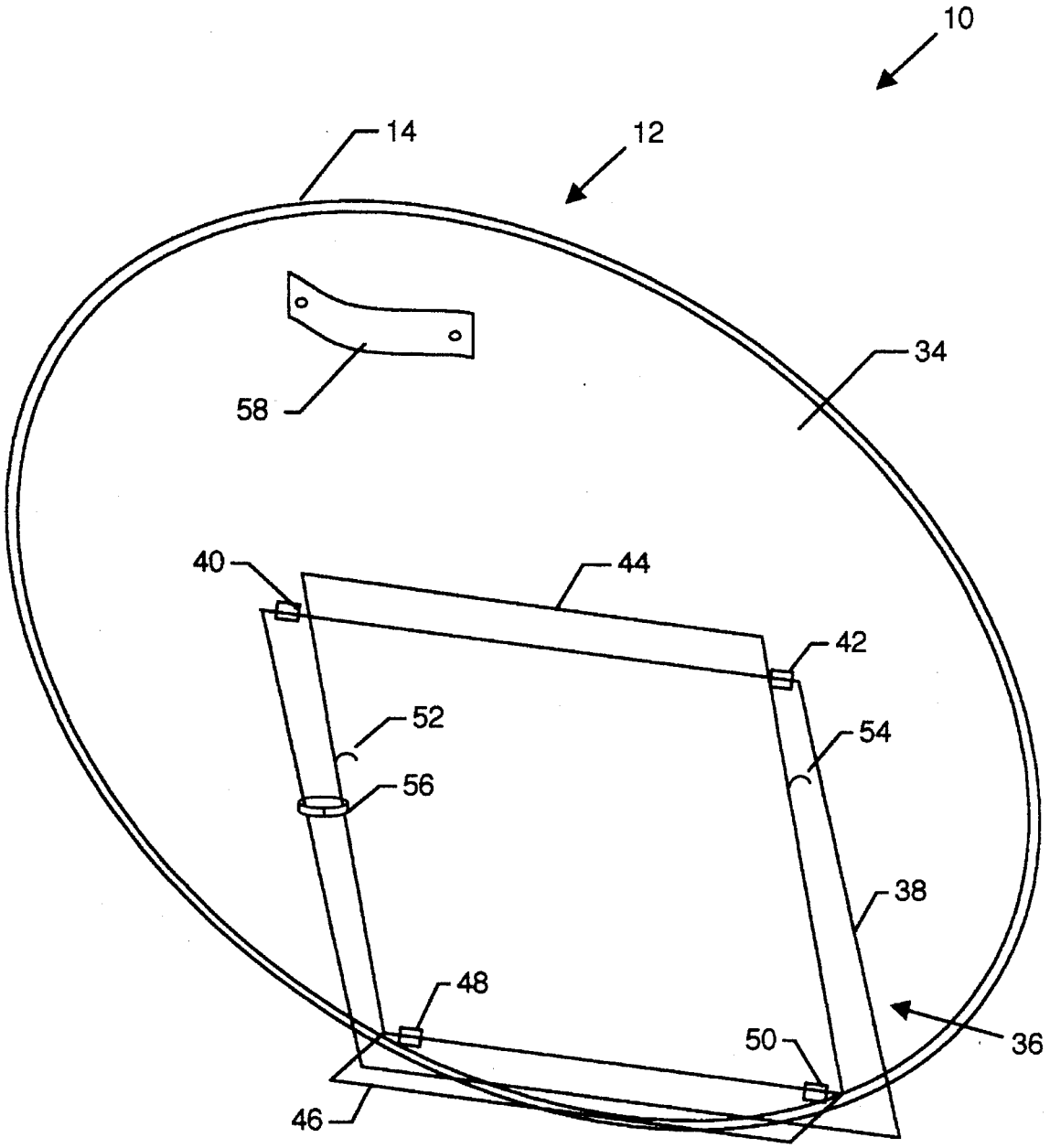
FIG. 3 illustrates a rear view in perspective of the present invention where the stand is collapsed against the mirror backing.

The rearward side of the golf training system 10 is described in FIGS. 2 and 3.

FIG. 2 illustrates the rearward side of the golf training system 10 where all numerals correspond to those elements previously described. The golf training system 10 includes a planar backing board 34 secured within the bounds of the framework 14. A non-adjustable stand 36, but collapsible, secures to the planar backing board 34 to hold the convex PLEXIGLASS mirror 12 in a fixed angular position with respect to the ground. The non-adjustable stand 36 is collapsible and stores parallel to the planar backing board 34 as illustrated in FIG. 3. The upper stand member 38 is rectangular in shape and is pivotally secured to the planar backing board 34 by pivot mounts 40 and 42. The lower stand member is comprised of a rectangular shaped member 44 and a three-sided foot member 46 attached to two corners of the rectangular shaped member 44. The rectangular shaped member 44, with the attached three-sided foot member 46, pivotally secures to the planar backing board 34 with pivot mounts 48 and 50. The rectangular shaped member 44 includes catches 52 and 54 extending from two opposing legs of the rectangular shaped member 44. These catches 52 and 54 engage the lower portion of the upper stand member 38 as illustrated so that ground support of the convex PLEXIGLASS mirror 12 is provided for by the lower most portion of the rectangular shaped member 44 and the lower most portion of the three-sided foot member 46. A flexible hook and loop device 56, such as VELCRO, is also provided to secure the non-adjustable stand 36 against the planar backing board 34 when the non-adjustable stand 36 is collapsed for storage or transport. A flexible fabric handle 58 secures to the upper portion of the planar backing board 34.

FIG. 3 illustrates a rearward view of the golf training system 10 where all numerals correspond to those elements previously described. The non-adjustable stand 36 is collapsed against the planar backing board 34 by disengaging the lower portion of the upper stand member 38 from the catches 52 and 54 and then swinging the upper stand member to a horizontal position. The rectangular shaped member 44, being of a lesser horizontal dimension than that of the upper stand member 38, is swung upwardly and through the interior area of the upper stand member 38 until reaching a position against the planar backing board 34. The upper stand member 38 is then positioned from its horizontal position to a vertical position parallel to and against the planar backing board 34. The hook and loop device 56 is then employed to capture appropriate sides of the upper stand member 38 and the rectangular shaped member 44 for storage and/or transport.

Figure 4:
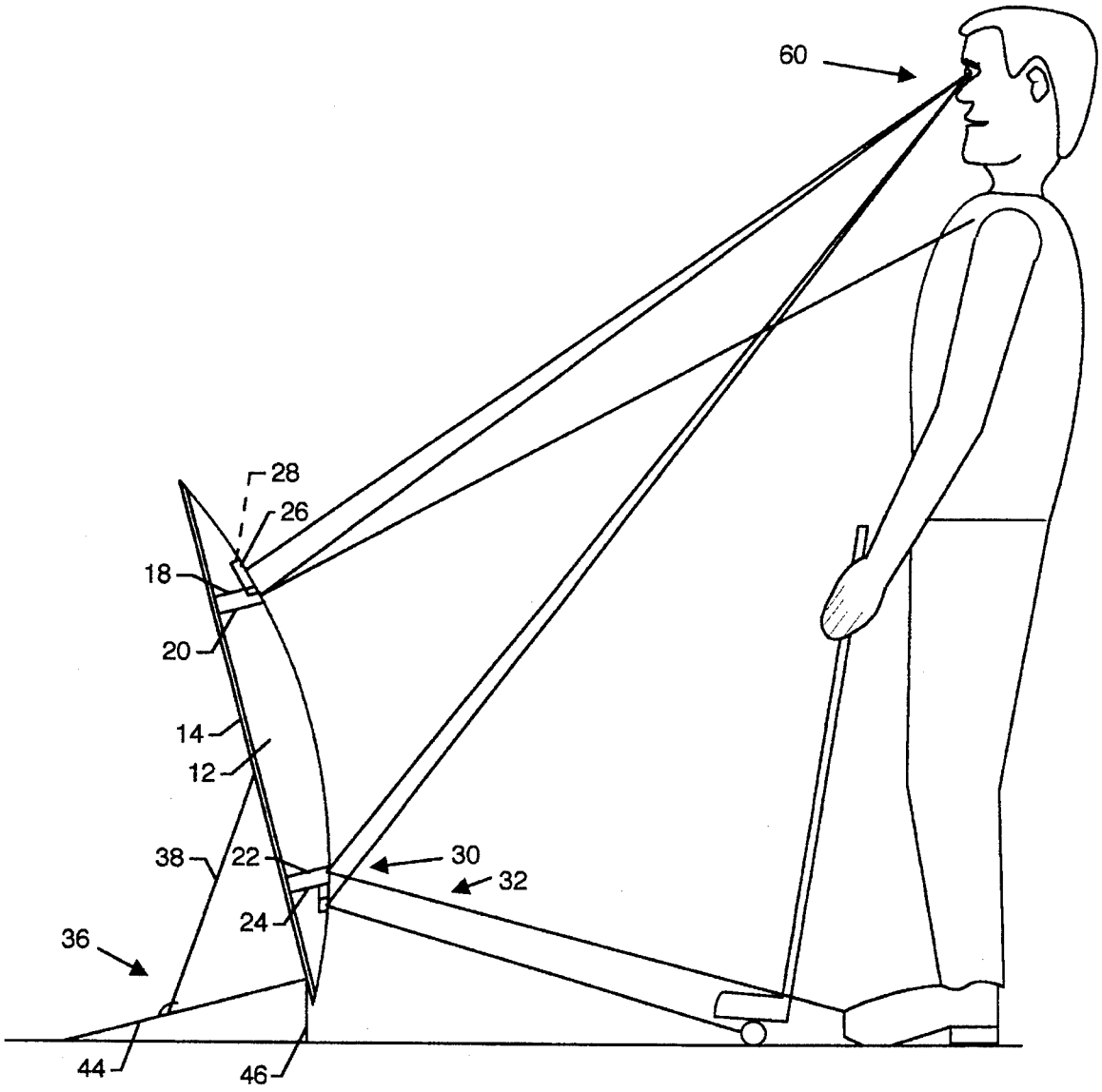
FIG. 4 illustrates the reflective feature of the present invention.

FIG. 4 illustrates the sight lines used by a golfer 60 to properly establish his position with reference to the lined markings on the surface of the mirrored surface of the mirror 12. All other numerals correspond to those elements previously described. The player positions oneself approximately to align his shoulders between the shoulder lines 18 and 20, his feet aligned in the foot lines 22 and 24, and his head in either head box 28 or 26 depending whether he is a left or right handed golfer. The ball is placed in either of the ball boxes 30 or 32 depending on the type of club used.

Figure 5:
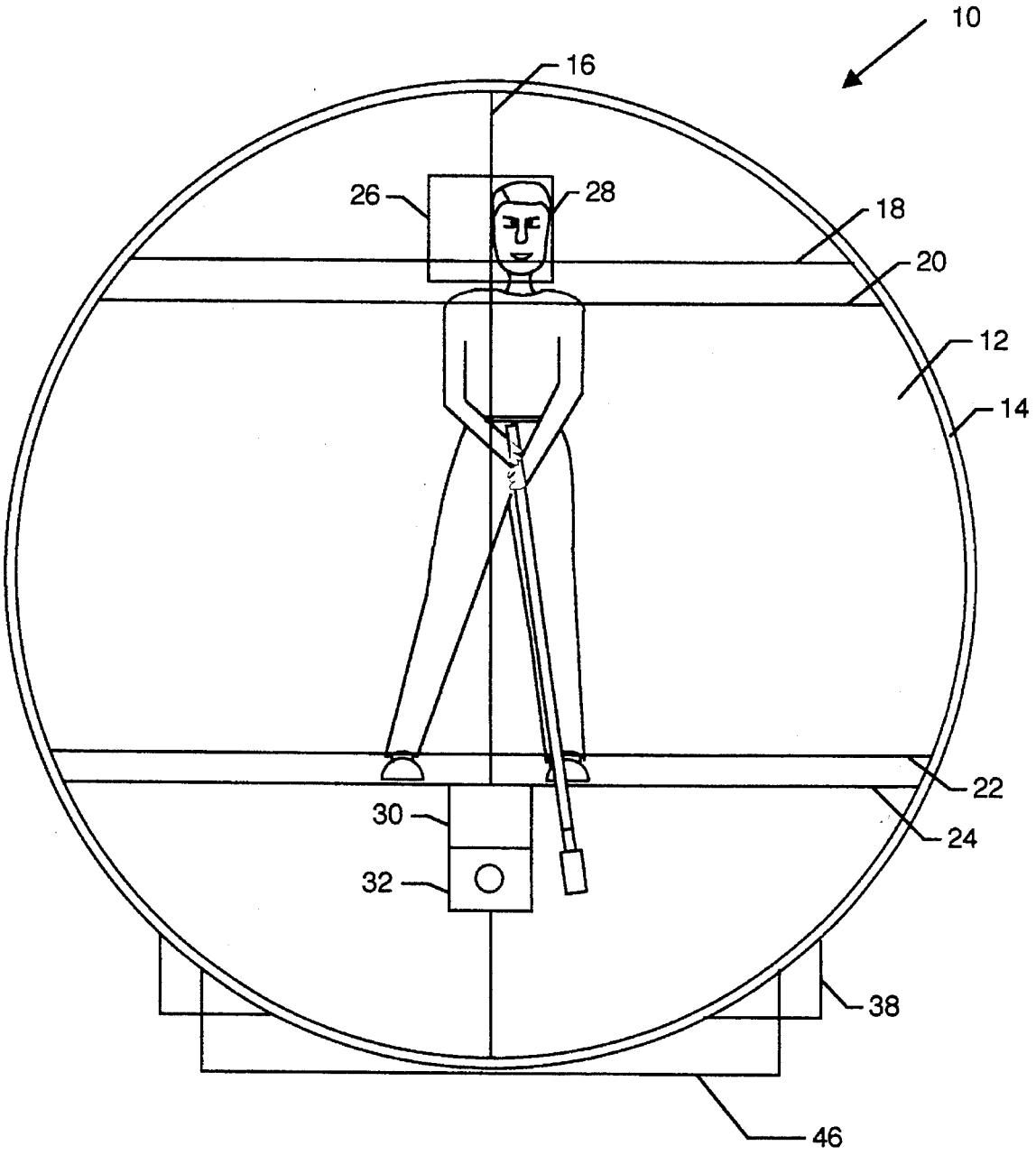
FIG. 5 illustrates an image of a golfer as seen by the golfer in the golf training air mirror.

FIG. 5 illustrates the image of the golfer in the mirror 12 as seen by oneself where all numerals correspond to those elements previously described.

MODE OF OPERATION

FIGS. 4 and 5 best illustrate the mode of operation.

When used in conjunction with the present invention, the golfer can learn the proper mechanics of the golf swing and repeat them at home or on the driving range. Whether a golfer is short, tall, light, heavy or average, the present invention can be incorporated to any golfer's height, build and swing by virtue of the properties of the convex mirror 12. The present invention allows a beginner, a senior player or an aspiring golfer to obtain complete imagery of their stance angle, swing path and every movement from addressing the ball to completion of their stroke. This golf mirror training system 12 enables the golfer to watch himself/herself before, during and after the golf swing. The golfer can check his/her alignment while addressing the ball and can watch their backswing and forward swing. The golfer can stop his/her swing at any time and can observe the cocking of the wrists, the turn of the shoulders and/or hips, and their leg positions.

A full-view vision of the golfer's stance helps one develop proper lower body stability while showing the proper turn of the upper body and shoulders. The detailed horizontal lines 26–28 and 22–24 show the position of shoulders and feet; the vertical line 16 in the center indicates the perfect position of feet and hands in relation to the ball. This creates perfect alignment at address and during the stroke. It also reflects shoulder and chest alignment during the stroke.

The mirror is placed on level ground and the top part of the stand 38 placed into the lower stand's locking hooks 52 and 54. The stand is a two-bar linkage. The ball is placed on the ground and aligned in the center of either of the bottom squares 30 and 32, approximately 12–18" away from mirror 10. The bottom square 32 is used for driver and long irons and the top square 30 is used for wedge and short irons. For right-handed golfer the head should be centered in the head square 28 and slightly to right of the center line 16. Left-handed golfers would use head square 26. Feet and shoulders are then aligned parallel with the upper and lower parallel line sets 18–20 and 22–24, respectively. The vertical line is the center line and also indicates the position of the feet and hands in relation to the ball at address. The mirror is a coated polymer member.

Various modifications can be made to the present invention without departing from the apparent scope hereof.

I claim:

1. A golf training system comprising:

a. a convex mirror having a top side and a bottom side;

b. a stand means connected to said mirror means to support said mirror means with the top side up;

c. a vertical line on the mirror generally bisecting the mirror;

d. a horizontal shoulder line on the mirror generally adjacent the top side of the mirror, for alignment with the golfer's shoulders;

e. a head box on the mirror at least partially above the shoulder line and adjacent to the vertical line;

f. a central area on the mirror free of horizontal lines and boxes for reflecting an image of the golfer; and, g. a horizontal foot line on the mirror below the central area for alignment with the golfer's feet.

2. The system of claim 1 wherein said stand means includes an upper stand and a lower stand, said lower stand including hooks to receive said upper stand and both of said stands pivoting on a back of said mirror means.

3. The system of claim 1 including a second shoulder line on an upper portion of said mirror.

4. The system of claim 1 including a second head box above said shoulder line.

5. The system of claim 1 including a second foot line.

6. The system of claim 1 including at least one ball box on said mirror below the foot line.

7. The system of claim 1 including a second ball box below the foot line.

8. The system of claim 1 wherein said mirror is a polymer mirror.

9. A golf training system comprising:

a. a convex mirror;

b. a two-bar linkage stand means connected to said mirror means to support said mirror means;

c. a vertical line on the mirror generally bisecting the mirror;

d. a horizontal shoulder line on the mirror generally adjacent the top side of the mirror, for alignment with the golfer's shoulders;

e. a head box on the mirror at least partially above the shoulder line and adjacent to the vertical line;

f. a central area on the mirror free of horizontal lines and boxes for reflecting an image of the golfer; and, g. a horizontal foot line on the mirror below the central area for alignment with the golfer's feet.

10. The system of claim 9 wherein said stand means includes an upper stand and a lower stand, said lower stand including hooks to receive said upper stand and both of said stands pivoting on a back of said mirror.

11. The system of claim 9 including a second shoulder line on an upper portion of said mirror.

12. The system of claim 9 including a second head box above said shoulder line.

13. The system of claim 9 including a second foot line.

14. The system of claim 9 including at least one ball box on said mirror below the foot line.

15. The system of claim 9 including at least two ball boxes on said mirror below the foot line.

16. A process for golfing practice comprising the steps of:

a. supporting a convex mirror on a stand, the mirror having horizontal foot lines, horizontal shoulder lines, at least one head box, and at least one ball box on said surface of said mirror, and having a central area free of boxes and horizontal lines;

b. aligning a shoulder so that its reflection is within the shoulder lines and a foot so that reflection is within the foot lines;

c. aligning a head in said head box; and, d. aligning a golf ball in said ball box, 17. A golf training mirror for viewing a golfer's body to determine proper swing alignment comprising:

a. a convex mirror having a reflective surface generally free of lines for viewing reflection of a golfer's body;

b. at least one pair of horizontal lines on the reflective surface for alignment with a specific part of a golfer's body;

c. at least one rectangular box on the reflective surface for alignment with a second specific part of the golfer's body; and, d. a vertical line generally bisecting the reflective surface for aligning the golfer's body.

18. The mirror of claim 17 wherein the horizontal lines are for alignment of the shoulders, and further comprising a second pair of horizontal lines spaced apart and below the first set of horizontal lines for alignment with the golfer's feet.

19. The mirror of claim 18 wherein the box is for alignment with the head and is adjacent and on one side of the vertical line.

20. The mirror of claim 19 further comprising a second head box on the reflective surface generally adjacent to the first head box and on an opposite side of the vertical line.

21. The mirror of claims 18 or 20 further comprising a box adjacent the vertical line and below the foot lines for alignment with the golf ball.

* * * * *